US006389927B1

(12) United States Patent
Willemsen

(10) Patent No.: US 6,389,927 B1
(45) Date of Patent: May 21, 2002

(54) ADJUSTABLE CONTROL VEHICLE PEDAL

(75) Inventor: Larry G. Willemsen, Morpeth (CA)

(73) Assignee: KSR International, Inc., Southfield, MI (US)

( * ) Notice: Subject to any disclaimer, the term of this patent is extended or adjusted under 35 U.S.C. 154(b) by 0 days.

(21) Appl. No.: 09/614,101

(22) Filed: Jul. 12, 2000

(51) Int. Cl.[7] ..... G05G 1/14
(52) U.S. Cl. ..... 74/514; 74/560
(58) Field of Search ..... 74/512, 513, 514, 74/560

(56) References Cited

U.S. PATENT DOCUMENTS 3,691,868 A 9/1972 Smith ..... 74/512
5,211,072 A * 5/1993 Barlas et al. ..... 74/512
5,351,573 A * 10/1994 Cicotte ..... 74/512
5,460,061 A * 10/1995 Redding et al. ..... 74/512
5,819,593 A 10/1998 Rixon et al. ..... 74/514
5,884,532 A * 3/1999 Rixon et al. ..... 74/512
5,937,707 A 8/1999 Rixon et al. ..... 74/560
5,996,438 A * 12/1999 Elton ..... 74/512
6,019,015 A * 2/2000 Elton ..... 74/513

* cited by examiner

*Primary Examiner*—David Fenstermacher
*Assistant Examiner*—Vicky A. Johnson
(74) *Attorney, Agent, or Firm*—Gifford, Krass, Groh, Sprinkle, Anderson & Citkowski, P.C.

(57) ABSTRACT

An adjustable control pedal for use in "fly-by-wire" applications. The control pedal arrangement includes a base member having integral support arms for supporting a pedal arm and drive device and control mechanism. The control mechanism includes a motor with a gear for driving a screw rod. The screw rod extends between the base and the pedal arm to adjust the position of the pedal arm with respect to the operator.

8 Claims, 2 Drawing Sheets

ADJUSTABLE CONTROL VEHICLE PEDAL

FIELD OF INVENTION

This invention relates to control pedals, more particularly to the powered adjustment of the position of such pedals.

BACKGROUND OF THE INVENTION

A variety of adjustable control pedal arrangements have been provided to complement other adjustments to other mechanisms such as adjustable steering wheels and seats to accommodate drivers of different sizes.

Adjustable pedal systems typically have attempted to utilize existing mounting brackets and the like and require the separate installation of the various components such as pedals, electronic controls and the motor for powering the arrangement with the accompanying need to tailor each of the various components to the available mounting arrangements in a specified vehicle.

It is an object of the invention to provide adjustable pedal control assembly for vehicles which can be fabricated as a complete assembly to include the control mechanism control pedal and the motor for adjusting the mechanism as a complete assembly to eliminate the need of customizing the various parts in an effort to utilize existing mounting structures.

It is another object of the invention to provide an adjustable pedal assembly which can be installed as a unit in original equipment or in the after market without need for elaborate redesign of mounting structures or components.

SUMMARY OF THE INVENTION

These and other objects of the invention are accomplished by a mounting bracket which acts as a base member to support the remaining components of the total control assembly such as the motor, control mechanism, the pedal arm and drive mechanism. The complete assembly includes a bracket adapted for mounting on the wall of a vehicle adjacent to the driver's position, a control member pivotally mounted on the bracket, a pedal pivotally mounted to the control member, an electronic control means forming part of the control member and responsive to the degree of relative movement of the control member and the pedal to produce a control signal proportional to the pivotal movement together with a motor mounted directly on the bracket with means connecting the motor to the control member for pivoting it together with the pedal arm to selected positions relative to the driver's position.

BRIEF DESCRIPTION OF THE DRAWINGS

Other objects features and advantages of the present invention will become apparent by reference to the following description and to the drawings in which.

DETAILED DESCRIPTION OF THE DRAWINGS

Figure 1:
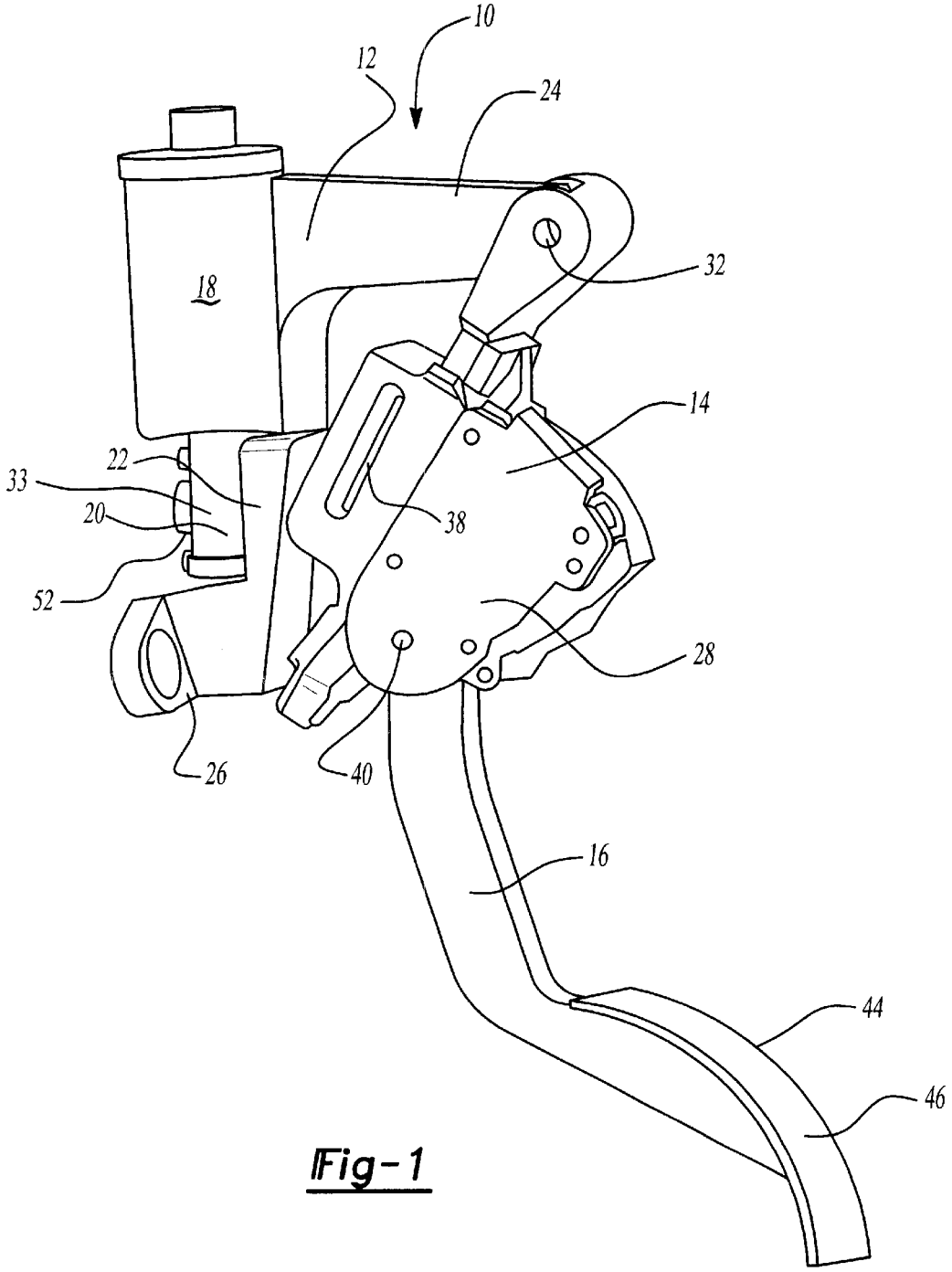
FIG. 1 is a perspective view of the adjustable control pedal assembly embodying the invention.

Referring to the drawing and particularly to FIG. 1, the pedal adjusting assembly embodying the invention is designated generally at 10 and includes a bracket member 12 which supports a control mechanism 14, a pedal arm 16 and a motor 18 as well as drive means 20 connecting the motor to the control mechanism 14 for powered movement of the latter.

The bracket member 12 is intended for mounting in the passenger compartment on the fire wall immediately ahead of the driver's position. The bracket member 12 is in the form of an inverted L with the main leg extending generally vertically to form a support arm 22 and the shorter leg extending generally horizontally and forming a support arm 24 generally parallel to the longitudinal axis of the vehicle. The bracket member 12 forms a support for the electric motor 18. The motor housing is attached to the bracket member 12 in a fixed position by conventional fastening means (not shown) and is disposed with its axis of rotation substantially vertically and parallel to the longer leg 22 of the inverted L shaped bracket 12.

The lower end of the bracket member 12 is provided with mounting bosses 26 to receive bolts by which the entire assembly 10 can be fastened to the wall of the vehicle.

The control mechanism or member includes a housing 28 having an arm 30 extending upwardly from the top of the housing and having the free end which is bifurcated to receive the outer end of the bracket arm 24. The aligned ends of the arm 30 and support arm 22 receive a pivot pin, which forms a generally horizontal pivot axis 32 extending transversely to the direction of movement of the vehicle. The control member 14 is suspended from the upper arm 24 of the bracket 12.

The motor 18 is connected to control member 14 by the drive means to provide motion to pivot the control member relative to its pivot axis 32. The drive means 20 includes a housing 33 containing a threaded drive shaft 34 which extends at right angles to the main drive shaft of the motor. The main drive shaft has worm gear portion which engages the threaded drive shaft 34. An end 50 of the threaded drive shaft 34 is connected to pivot within a slide block 36. The slide block 36 is slidably supported in the slot 38 formed in the control member 14 with the slot extending generally radially from the pivot axis 32. A cylindrical portal 52 of the housing 33 is formed to accept an other end 54 of the drive shaft 34 when the pedal arm is in its fully retracted position. Alternatively, and not shown, the drive shaft 34 may be threadably received through the slide block 36 and the other end 54 of the drive shaft 34 may be provided with a pinion gear to engage the worm gear portion of the main drive shalt of the motor. Actuation of the motor and rotation of the drive shaft 34 causes the control member to be pivoted about its pivot axis 32. During such movement, the arcuate movement of the control member 14 is accommodated by movement of the slide block 36 in the slot 38.

The pedal arm 16 is pivotally connected to the control member 14 for relative movement about a pivot axis indicated generally at 40 and extending parallel to and below pivot axis 32. Movement of pedal arm relative to control member 14 is effective to produce an electronic control signal proportional to the position of the control member 14 and pedal arm 16 for the operation of brakes, transmissions or engine controls, such controls are available commercially from Hella of Germany.

The end of pedal arm 16 is provided with pedal pad support 44 which has a curved, convex upper surface 46. When the brake pedal arm 16 is in a fully forward position the forward portion of the pedal pad 44 is in position for depression by the driver. When the pedal is adjusted toward the rear of the vehicle, the pedal raises and the rear portion of the convex surface 46 is in a position for engagement by the foot of the driver. The pedal pad support 44 is preferably cast as an integral portion of the pedal arm 16. If desired a standard elastomeric pedal pad can be mounted on the pedal pad support 44.

The adjustable pedal assembly 10 may be supplied in its assembled condition for installation as a unit in the vehicle. After mechanical connections are made to support the unit in the vehicle, various electrical connections can be made between the control mechanism 14 and the mechanisms to be operated, such as brakes, transmission and throttles.

Figure 2:
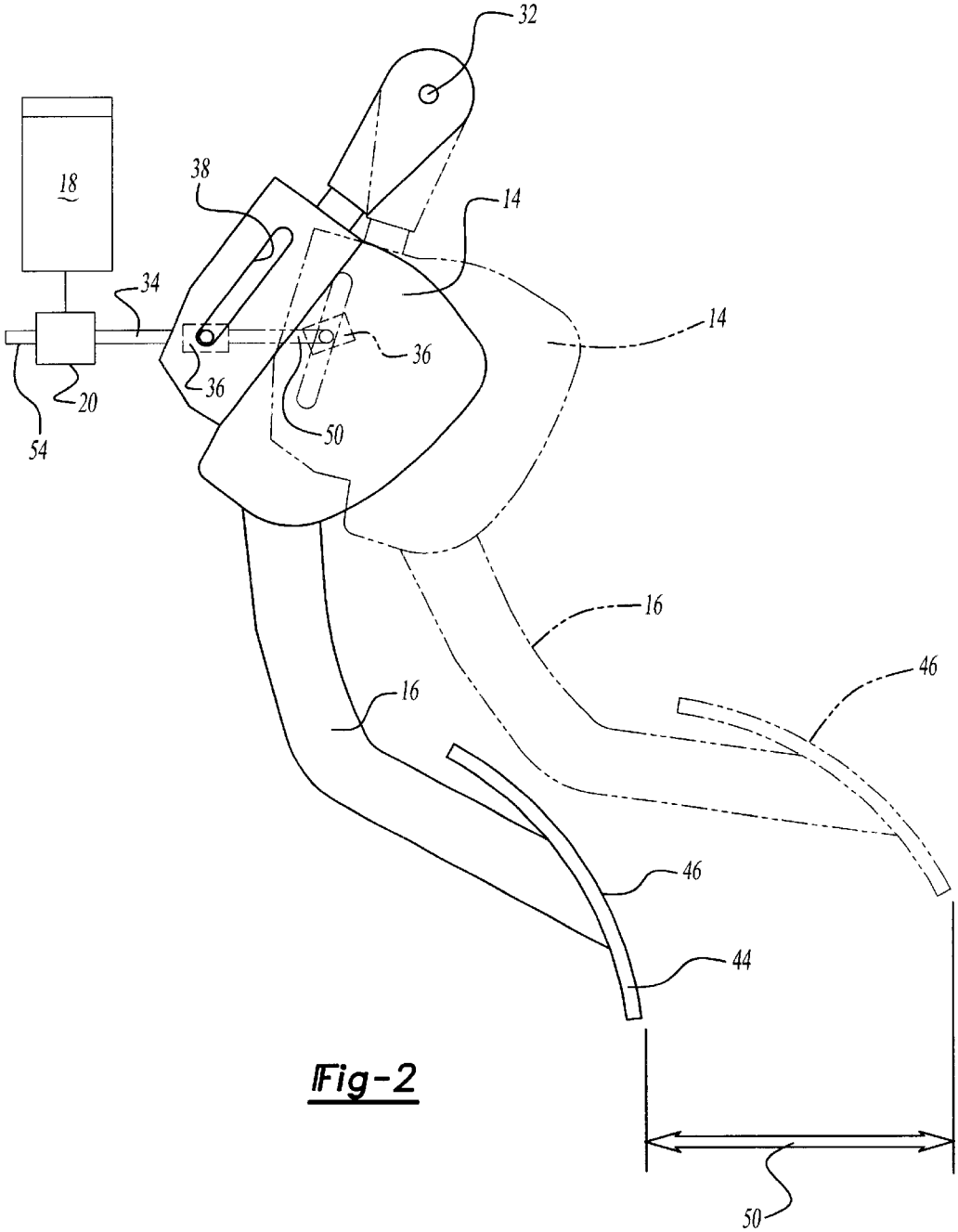
FIG. 2 is a diagrammatic side view of mechanism seen in FIG. 1 showing the range of operation.

In operation, a control such as a switch is activated to energize the motor 18 which causes pivoting of the control mechanism 14 and pedal arm 16 to selected positions relative to a unit bracket to the bracket 12 and therefore the vehicle itself as best seen in FIG. 2. Such actuation of the motor 18 causes the control mechanism 14 and pedal arm 16 to move as a unit between the extreme positions indicated in full line and in broken line in FIG. 2 with the extent of adjustment indicated by the arrow 50. During such movement, the drive shaft 34 transmits its rotary motion to the slide block 36 which moves in the slot 38 to permit arcuate pivotal movement of the control mechanism 14 together with pedal arm 16 about the pivot axis 32. Subsequent movement of the pedal arm 16 relative to the stationary control mechanism 14 produces an electronic signal for operating various mechanisms of the vehicle and such a signal is in direct proportion to the relative positions of the control mechanism 14 and pedal arm 16 during the full range of movement of the control mechanism 14.

What is claimed is:

1. An adjustable pedal assembly for motor vehicles comprising:

a bracket adapted for mounting on a vehicle;

a control member mounted on said bracket for pivotal movement about a first axis generally horizontal and transverse to the vehicle;

a pedal mounted on said control member for pivotal movement relative thereto about a second axis parallel to said first axis;

electronic control means forming part of said control member and responsive to the degree of relative movement of said control member and said pedal to produce a control signal proportional to such movement;

a drive apparatus mounted on said bracket; and a screw member mounted to said bracket to pivot to said control member, said drive apparatus being operatively connected to said screw member to pivot said control member when said drive apparatus is activated.

2. The pedal assembly of claim 1 wherein said screw member is received in a complementary threaded member, said complementary threaded member slidably supported in a slot formed in said control member.

3. The pedal assembly of claim 1 wherein said screw member extends on a third axis which is orthogonal to and spaced apart from said first axis.

4. The pedal assembly of claim 2 wherein said slot extends substantially radially of said first axis.

5. An adjustable control pedal assembly for adjusting the position of a pedal relative to the operator of a vehicle comprising:

a bracket member adapted to be supported in a generally vertical position, the driver's position in said vehicle, a control member connected to said bracket for pivotal movement about a first axis;

a pedal connected to said control member for pivotal movement about a second axis parallel to said first axis;

a signal means forming part of said control member and being responsive to the movement of said control member and pedal to produce an electrical signal proportional to the degree of movement of said control member and pedal; and a screw member supported by said bracket and connected to said control member for movement of said control member and pedal as a unit to selected angular positions relative to said bracket.

6. The pedal assembly of claim 5 wherein said screw member is received in a complementary threaded member, said complementary threaded member slidably supported in a slot formed in said control member.

7. The pedal assembly of claim 5 wherein said slot extends substantially radially of said first axis.

8. An adjustable pedal assembly for motor vehicles comprising:

bracket member adapted to be supported in a motor vehicle, said bracket having an arm extending toward the operator of said vehicle;

a control member pivoted to a free end of said arm at a first pivot axis;

a pedal connected to said control member for pivotal movement about a second pivot axis, said pedal having a pad element at one end for engagement by a foot of the operator;

electronic signal means forming part of said control member and being capable of developing a electronic control signal proportional to the movement of said pedal relative to said control member about said second pivot axis for all angular positions of said control member and pedal;

motor means supported on said bracket; and a screw member connecting said motor means to said control member to pivot said control member and said pedal as a unit about said first pivot axis to position said pad element of said pedal relative to the operator of said vehicle.

* * * * *

UNITED STATES PATENT AND TRADEMARK OFFICE

CERTIFICATE OF CORRECTION

PATENT NO. : 6,389,927 B1
DATED : May 21, 2002
INVENTOR(S) : Larry G. Willemsen

It is certified that error appears in the above-identified patent and that said Letters Patent is hereby corrected as shown below:

Column 1,
Line 3, replace “FIELD OF INVENTION” with -- FIELD OF THE INVENTION --.
Line 22, replace “control mechanism” with -- control mechanism, --.
Line 52, replace “object” with -- object, --.
Line 54, replace “which.” with -- which: --.
Line 57, replace “mechanism” with -- the mechanism --.

Column 2,
Line 60, insert “support” after -- pedal --.

Column 4,
Line 30, before “bracket” insert -- a--.

Signed and Sealed this

Thirty-first Day of December, 2002

JAMES E. ROGAN
*Director of the United States Patent and Trademark Office*

US006389927C1

(12) EX PARTE REEXAMINATION CERTIFICATE (7498th)

United States Patent
Willemsen

(10) Number: US 6,389,927 C1
(45) Certificate Issued: May 11, 2010

(54) ADJUSTABLE CONTROL VEHICLE PEDAL

(75) Inventor: Larry G. Willemsen, Morpeth, CA (US)

(73) Assignee: KSR International, Inc., Southfield, MI (US)

Reexamination Request:
No. 90/006,356, Aug. 14, 2002

Reexamination Certificate for:

| | |
|---|---|
| Patent No.: | **6,389,927** |
| Issued: | **May 21, 2002** |
| Appl. No.: | **09/614,101** |
| Filed: | **Jul. 12, 2000** |

Certificate of Correction issued Dec. 31, 2002.

(51) Int. Cl.
*G05G 1/30* (2006.01)

(52) U.S. Cl. ..... 74/514; 74/560
(58) Field of Classification Search ..... 74/512–514, 74/560
See application file for complete search history.

(56) References Cited

U.S. PATENT DOCUMENTS

| | | | | | |
|---|---|---|---|---|---|
| 2,860,720 | A | | 11/1958 | Huff et al. | 180/90.6 |
| 4,470,570 | A | | 9/1984 | Sakurai et al. | 244/235 |
| 4,875,385 | A | * | 10/1989 | Sitrin | 74/512 |
| 5,056,742 | A | | 10/1991 | Sakurai | 244/235 |
| 5,086,663 | A | * | 2/1992 | Asano et al. | 74/512 |
| 5,121,889 | A | | 6/1992 | Carey, Jr. | 244/234 |
| 5,125,483 | A | | 6/1992 | Kitagawa et al. | 188/158 |
| 5,697,260 | A | * | 12/1997 | Rixon et al. | 74/514 |
| 5,884,532 | A | * | 3/1999 | Rixon et al. | 74/512 |
| 5,996,438 | A | * | 12/1999 | Elton | 74/512 |
| 6,019,015 | A | * | 2/2000 | Elton | 74/513 |
| 6,151,984 | A | | 11/2000 | Johansson et al. | 74/512 |
| 6,151,985 | A | | 11/2000 | Garber et al. | 74/512 |
| 6,151,986 | A | | 11/2000 | Willemsen et al. | 74/512 |
| 6,173,625 | B1 | * | 1/2001 | McFarlane et al. | 74/512 |
| 6,178,847 | B1 | | 1/2001 | Willemsen et al. | 74/512 |
| 6,212,970 | B1 | * | 4/2001 | Bortolon | 74/512 |
| 6,289,761 | B1 | * | 9/2001 | Reynolds et al. | 74/512 |
| 6,305,239 | B1 | | 10/2001 | Johansson et al. | 74/512 |
| 6,324,939 | B1 | * | 12/2001 | Cicotte | 74/512 |
| 6,367,348 | B1 | * | 4/2002 | Toelke et al. | 74/512 |
| 6,431,021 | B1 | * | 8/2002 | Djordjevic et al. | 74/512 |
| 2002/0002874 | A1 | * | 1/2002 | Burton et al. | 74/512 |
| 2003/0056615 | A1 | * | 3/2003 | Oberheide et al. | 74/512 |

FOREIGN PATENT DOCUMENTS

| | | |
|---|---|---|
| DE | 19757084 | 6/1999 |
| EP | 0918273 | 5/1999 |

* cited by examiner

*Primary Examiner*—Vinh T. Luong

(57) ABSTRACT

An adjustable control pedal for use in "fly-by-wire" applications. The control pedal arrangement includes a base member having integral support arms for supporting a pedal arm and drive device and control mechanism. The control mechanism includes a motor with a gear for driving a screw rod. The screw rod extends between the base and the pedal arm to adjust the position of the pedal arm with respect to the operator.

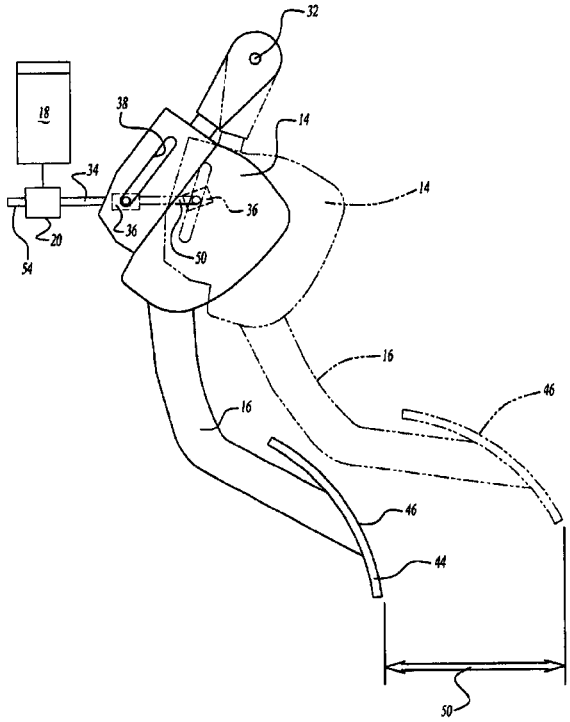

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5–8 are cancelled.

Claim 1 is determined to be patentable as amended.

Claims 2–4, dependent on an amended claim, are determined to be patentable.

1. An adjustable pedal assembly for motor vehicles comprising:

[a] *an inverted L-shaped* bracket *having a leg portion that is* adapted for mounting on a vehicle *and one arm portion extending longitudinally from said leg portion to a free end*;

a control member [on] *having an uppermost end pivotally mounted to an outermost portion of the free end of* said [bracket] *arm* for pivotal movement about a first axis *that is* generally horizontal and transverse to the vehicle, *and is stationary*;

a pedal mounted [on] *to a lower end of* said control member for pivotal movement relative thereto about a second axis *that is* parallel to *and below* said first axis; electronic control means forming part of said control member and responsive to the degree of relative movement of said control member and said pedal *about said second axis, and* and to produce a control signal proportional to such movement *about said second axis*;

a drive apparatus mounted [on] *to the leg portion of* said bracket; and a screw member [mounted to said bracket to pivot] *having one end operatively connected to said drive apparatus, and an opposite end slidingly connected* to said control member *between said first axis and said second axis*, [said drive apparatus being operatively connected to said screw member] to pivot said control member *said pedal together as a unit without relative movement between the control member and the pedal about said first axis,* when said drive apparatus is activated.

* * * * *